United States Patent [19]

Pope

[11] Patent Number: 4,491,457

[45] Date of Patent: Jan. 1, 1985

[54] DRILLING BIT

[75] Inventor: Noel C. Pope, Johannesburg, South Africa

[73] Assignee: Boart International Limited, Sandton, South Africa

[21] Appl. No.: 500,901

[22] Filed: Jun. 3, 1983

[51] Int. Cl.[3] ..... B24D 3/02

[52] U.S. Cl. ..... 51/308; 51/309

[58] Field of Search ..... 51/308, 309

[56] References Cited

U.S. PATENT DOCUMENTS 3,520,667 7/1970 Taylor ..... 51/309

4,054,426 10/1977 White ..... 51/309

4,128,136 12/1978 Generoux ..... 51/309

4,211,294 7/1980 Multakh ..... 51/309

4,353,963 10/1982 Lee et al. ..... 51/309

*Primary Examiner*—Torenzo B. Hayes

*Assistant Examiner*—Willie Thompson

*Attorney, Agent, or Firm*—Morgan, Finnegan, Pine, Foley & Lee

[57] ABSTRACT

In a diamond impregnated bit scourer particles in the form of silicon carbide are added to the matrix. The mesh size of the silicon carbide is less than that of diamond and the concentration preferably about 40, if the diamond concentration is 40.

3 Claims, 1 Drawing Figure

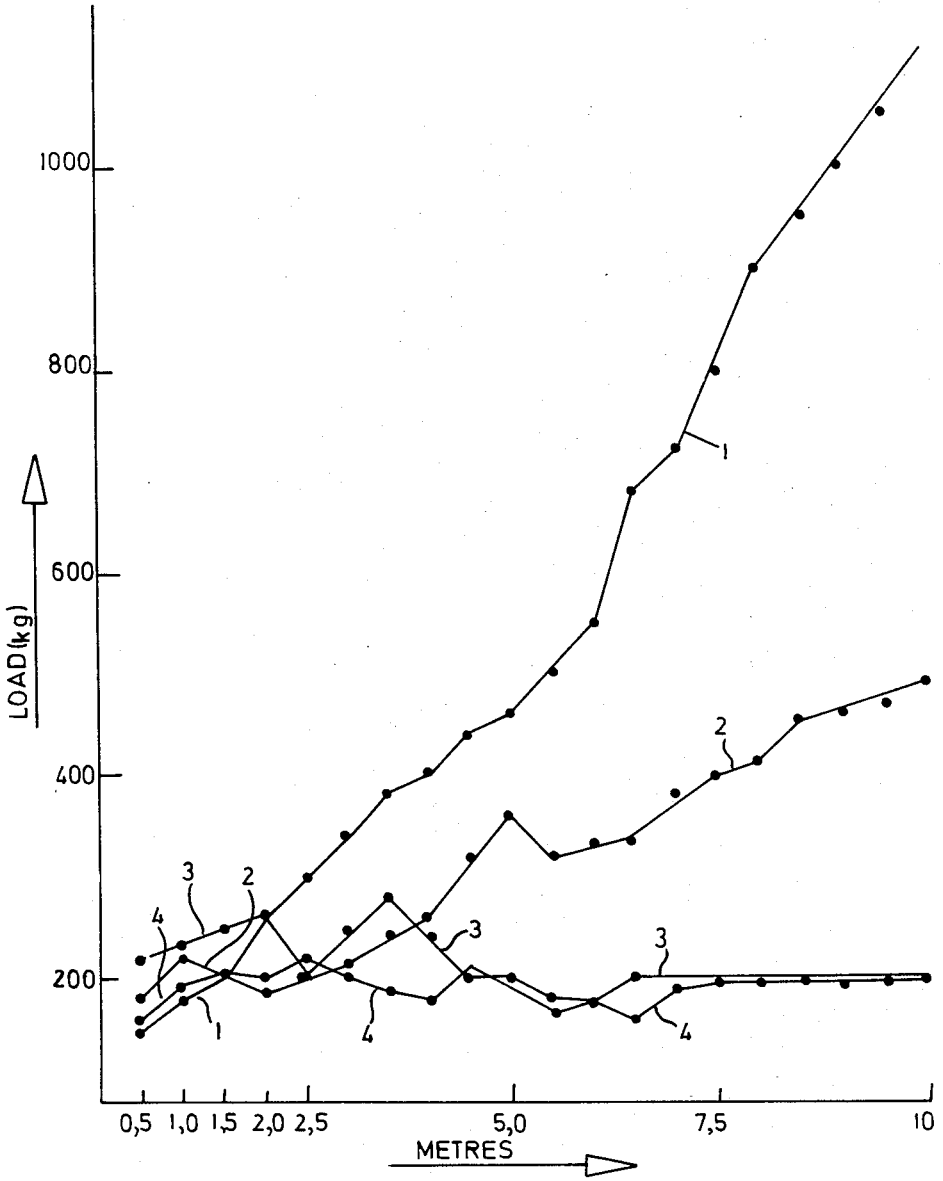
1000
800
600
400
200
LOAD (kg)
1
2
3
4
0,5
1,0
1,5
2,0
2,5
5,0
7,5
10
METRES

DRILLING BIT

FIELD OF THE INVENTION

This invention relates to an impregnated diamond drilling bit for attachment to the end of a drill string. The invention is particularly, but not exclusively, applicable to coring crowns which cut rock cores.

BACKGROUND OF THE INVENTION

Known impregnated coring crowns consist of a head (which performs the actual drilling) in the form of a matrix, prepared by powder metallurgical methods, in which the diamond particles are distributed as homogeneously as possible. In some instances the matrix consists of a bronze. In other cases, the matrix consists of one of, or a mixture of, tungsten, tungsten carbide, nickel and many other metals and refractory carbides infiltrated with a nickel bronze. The matrix depending on its composition may be prepared by either hot-pressing or by infiltration. Under the action of the applied forces on the bit resulting from the drilling machine acting on the rotating drill string behind the bit, the pressure that the individual diamond particles exert on small areas of the rock causes the rock to fragment into small particles. As the drilling proceeds the exposed surface of each diamond particle wears, and the matrix in between is also worn away. Should the matrix wear be insufficient, the active particles of diamond will eventually be worn flush with the matrix and new particles will not be exposed at a sufficently fast rate, drilling will no longer be possible and the bit can be said to have become "closed up".

It is an object of the invention to provide a matrix which will substantially ameliorate the above problems.

SUMMARY OF THE INVENTION

According to the present invention, there is provided an impregnated drilling bit which has a working face, the working face having diamond particles embedded in a matrix and the matrix including particles of a scouring agent selected from the group consisting of alumina, boron carbide and silicon carbide, the scouring agent particles being not larger than the diamond particles and preferably between one quarter and two thirds of the size of the diamond particles. The scouring agent particles are brittle and hard and have a limited ability to bond to the matrix.

When scouring agent particles are released during drilling operations they have the effect of scouring matrix from around the diamond particles and assist in maintaining a gap between the matrix at the face of the bit and the rock such that the bit remains open and can continue to drill efficiently.

The scouring agent particles are preferably silicon carbide particles which are between one half and two thirds of the size of the diamond particles. The silicon carbide particles are present in sufficient quantities that when they tear loose they will scour away matrix from around the diamond particles.

Another scouring agent which may be used in the present invention is alumina.

In choosing the matrix and the scouring agent, one must firstly ensure that the diamond particles will be firmly held. Secondly the scouring agent particles must break away in time to erode the matrix to keep the bit open, but not so soon as to deprive the working diamond particles of the support of the matrix.

DESCRIPTION OF THE DRAWING

It shows a series of graphs illustrating the performances of various bits.

DESCRIPTION OF EMBODIMENTS

Four bits were prepared and used in drilling tests to determine their performances. Each bit had the same diamond concentration, viz. 40 concentration and the diamond particles were 35/40 mesh. The bits had the same commercial bronze matrix to which silicon carbide was added as follows:

Bit No. 1: No addition.

Bit No. 2: 50/60 mesh SiC added in a concentration of 100, i.e. 25% by volume.

Bit No. 3: 50/60 mesh SiC added in a concentration of 40.

Bit No. 4: 45/50 mesh SiC added in a concentration of 40.

In the attached graph the performances of the four bits are illustrated, graph No. 1 showing that of Bit No. 1 and so on.

It will be seen that except during the very early stages the load required for drilling to the same depth is much larger for a bit with no SiC than for the other three bits. Also too much scouring agent (graph 2) is not to be recommended. 50/60 mesh and 45/50 mesh of the SiC work equally well.

I claim:

1. An impregnated drilling bit which has a working face, the working face having diamond particles embedded in a matrix and the matrix including particles of a scouring agent selected from the group consisting of alumina, boron carbide and silicon carbide, the scouring agent particles being not larger than the diamond particles.

2. The impregnated drilling bit claimed in claim 1 in which the scouring agent particles are between one quarter and two thirds of the size of the diamond particles.

3. The impregnated drilling crown claimed in either one of the above claims in which the scouring agent is silicon carbide.

* * * * *